United States Patent [19]

Reim et al.

[11] Patent Number: 4,502,262

[45] Date of Patent: Mar. 5, 1985

[54] INSERT PACKAGING DEVICE

[75] Inventors: Werner Reim, Waldbronn; Horst Garthe, Linkenheim, both of Fed. Rep. of Germany

[73] Assignee: IWK Verpackungstechnik GmbH, Stutensee, Fed. Rep. of Germany

[21] Appl. No.: 375,020

[22] Filed: May 5, 1982

[30] Foreign Application Priority Data

May 8, 1981 [DE] Fed. Rep. of Germany ..... 3118209

[51] Int. Cl.[3] ..... B65B 35/54

[52] U.S. Cl. ..... 53/157; 53/238

[58] Field of Search ..... 53/50, 117, 157, 238, 53/389; 198/457, 479; 271/204, 205, 206, 277

[56] References Cited

U.S. PATENT DOCUMENTS 2,263,501 11/1941 Jones ..... 53/157 X
3,982,382 9/1976 Vogel ..... 53/252
4,059,264 11/1977 Vogel ..... 53/157 X
4,320,894 3/1982 Reist et al. ..... 271/204 X

FOREIGN PATENT DOCUMENTS 1586137 4/1970 Fed. Rep. of Germany .
2834653 2/1980 Fed. Rep. of Germany ..... 53/117

*Primary Examiner*—Robert L. Spruill
*Assistant Examiner*—Donald R. Studebaker
*Attorney, Agent, or Firm*—Sandler & Greenblum

[57] ABSTRACT

Apparatus for positioning inserts relative to a product on a product chain prior to packaging the product in a product container, the apparatus includes insert transport belts for conveying the inserts to an insert pincer chain adapted to position the inserts relative to the product prior to release of the inserts from the insert pincer chain. The insert pincer chain is positioned below the product chain. The insert pincer chain is directed along the side of the product chain in a transfer zone at which the inserts are transferred from the insert pincer chain to the product chain.

11 Claims, 4 Drawing Figures

INSERT PACKAGING DEVICE

BACKGROUND OF THE INVENTION

1. Field of the Invention

The invention relates to an apparatus for conveying previously arranged enclosures for insertion into containers, such as cardboard boxes. The enclosures may be printed inserts relating to the product to be inserted in the container while the "products" being packaged may, for example, include vials, bottles, medicine bottles, blisterpacks, etc. The apparatus includes a product belt or chain provided with compartments into which the inserts and products are ultimately placed. The inserts are conveyed between conveyor belts and prior to insertion of the product, the inserts are delivered essentially perpendicularly to the product chain by means of a pincer insert chain which is arranged beneath the product chain which holds the insert in insert pincers.

The term "enclosures" is taken broadly to include prospectuses, instructions of use, package inserts, etc., and the term "insert" will be used throughout the specification generally to denote all types of enclosures generally.

2. Description of Prior Art

Generally, an apparatus of the above type is disclosed in German Offenlegungsschrift No. 15 86 137, published Apr. 23, 1970. In the apparatus disclosed the inserts are inserted by means of an adjustable endless conveyor belt at the middle of the product compartment. The belt has clips or insert pincers arranged such that before the inserts are brought to the product compartments the inserts are exactly centered with the products for insertion into the containers.

The basic advantage of such apparatus with respect to other apparatus which have not been described is that the inserts which ordinarily have previously been folded, can be positioned relative to a predetermined position of the product, e.g., with bottles directly opposite the flat side of the bottle neck. In the course of conveying the insert from the insert-supply, if necessary over an insert folding apparatus, the inserts are bent over a large angle, generally approximately 90° and furthermore are brought from a horizontal to a vertical position. In the known apparatus the inserts must be transferred at two locations, between the enclosure or insert conveyor, namely, from an input conveyor to a transfer apparatus and further to an insert pincer conveyor. Furthermore, in order to arrange the insert lengthwise the insert must be turned from the horizontal to the vertical by means of conveyor rails, after which the insert is contoured lengthwise. Particularly, with stiff insert materials this results in a risk of distortion. The alignments at the transfer points must, depending upon insert quality and format first be exact, and depending upon the case, be adjustable whereby the reliability of the apparatus suffers. With other apparatus the inserts are clamped under the product or are placed in a pocket in the product container. A disadvantage in such a system is first that the insert can only be brought to such a position with a great deal of difficulty, and beyond that, an exact positioning of the insert in front of the product, as is necessary with many products, is not possible. Furthermore, it is known, to apply the insert to the product within the product compartment whereby the insert is momentarily taken up in front of the rear wall of an insert compartment. As a result, the location of the insert relative to the product cannot be exactly positioned. Beyond that only inserts having limited formats are available.

SUMMARY OF THE INVENTION

It is, therefore, an object of the invention to provide an apparatus of the above type having high transport, and, in particular, high transfer reliability which is of simplified construction.

The above objectives are achieved by means of the apparatus of the invention in which the insert pincer chain is brought to an insert transfer zone which is on the side of the product chain. By virtue of the inventive movement path of the product chain, the insert pincer chain is freely brought to its insert or supplement pickup position such that the inserts or supplements are taken up freely and without additional guide means, and furthermore are transported in front of the specified product compartment, which normally has sidewalls which extend beyond the bottom edge of the product chain. More particularly, the insert pincer chain can overtake the enclosures or inserts in the vicinity of their guidance zone such that the inserts, which are not yet arranged edgewise, nor partially with the end on which the inserts are taken, are essentially periodically arranged in front of a product compartment by virtue of their own reversal without the insert being hindered or hit. As a result, it is possible to provide a basically simple takeup of the enclosure or insert by means of the insert pincer chain.

This simple takeup of the inserts was not previously easily achieved with conventional apparatus since, first, there was no room for direct takeup of the insert and, furthermore, the insert could not be diverted, at least without guides or rails at the perpendicular location, without hitting a portion of the product chain and thus being diverted.

By virtue of the deliverance and release at the takeup zone of the insert pincer chain, the inserts can be guided by means of a conveyor belt along a suitable direction directly to the insert pincer chain such that the insert can be transferred directly to the insert pincer chain.

After takeup of the inserts by the insert pincer chain the inserts are led directly in front of the product compartments and provided that these compartments have somewhat outstanding walls on their sides, the inserts are further stabilized at their locations.

Although the insert pincer chain basically can be brought at a slant to the product chain, according to a preferred embodiment the insert pincer chain extends from the takeup zone of the insert chain at an angle to the product chain and into a bend and runs in a direction parallel to the product chain. The inventive solution provides an advantageous arrangement in which the initially flat stacked folded inserts are brought to a transfer location between two transport belts and are released at the transfer zone with their edges tangential to the insert pincer chain. The insert pincer chains are directed in their reversal area over a preferably vertical linear path. By virtue of this arrangement the inserts are led by both drive means, i.e., both the conveyor belts and the insert pincer chains over an essentially parallel path such that the exact positioning of the transfer point is not critical. It is thus possible to form the apparatus such that the insert pincer chain is moving in the direction of the path of the insert being ejected. The inserts are transported directly from an insert folding apparatus by means of conveyor belts directly to the transfer zone. At this location the insert pincers of the insert pincer chain passing along a straight path are opened. The conveyor belts have a higher speed than the insert pincer chains and thus bring the inserts into the uptake of the insert pincers.

According to a preferred embodiment it is further provided that at the transfer zone an adjustable stop is provided for the accurate straightening of the insert by means of a straightening movement parallel to the transport direction. The higher reliability sought according to the invention is achieved essentially since only one transfer is required between various transport means, and on the other hand, the transport means can follow a longer parallel path. Since the inserts are not bent or contoured by means of guide rails, stiffer or multiple-ply folded inserts can be worked because they are always held in spaced positions during the entire transfer process and at no point in time are they bent by guide rails or contoured out of their movement direction.

BRIEF DESCRIPTION OF THE DRAWINGS

The invention will now be described by way of non-limiting example with reference to the annexed drawings in which.

DESCRIPTION OF PREFERRED EMBODIMENTS

The invention will now be described with reference to the drawings which illustrate only those aspects and portions of the apparatus which are essential for an understanding of the invention. Specifically, the drawings illustrate the portions of the apparatus which bring inserts in front of a product on a product chain for the insertion of products and inserts together in containers. The remaining portions of the apparatus which are not shown and with which the inventive apparatus may be used, may be of the type shown in German Offenlegungsschrift No. 15 86 137, published Apr. 23, 1970, the disclosure of which is hereby incorporated by reference.

Figure 1:
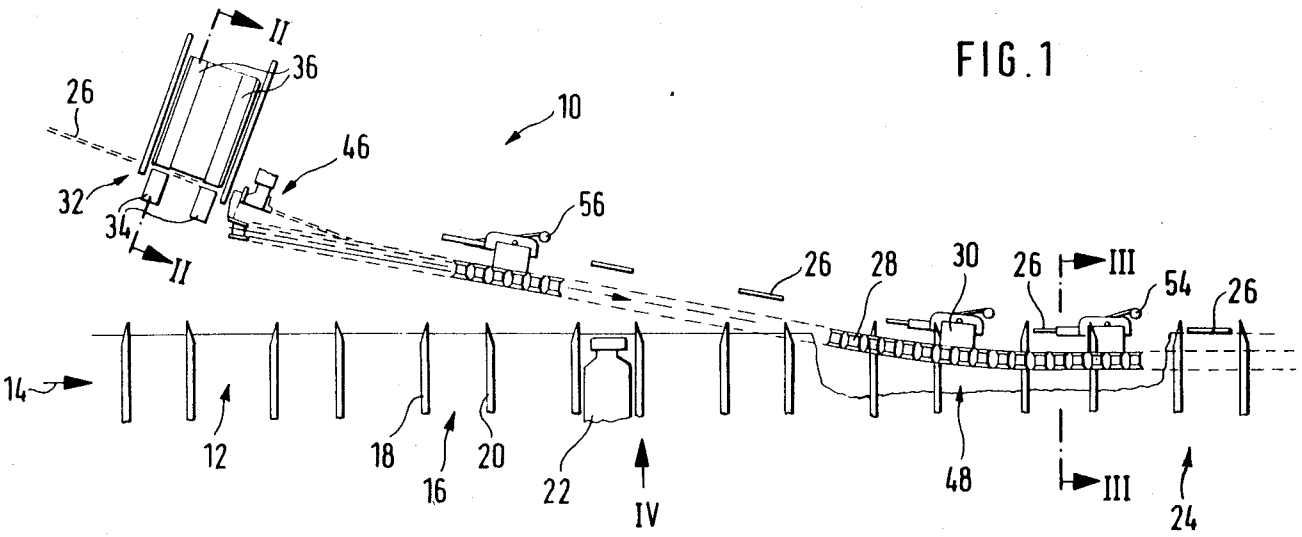
FIG. 1 is a view of the basic apparatus of the invention showing its essential parts.

Inventive apparatus 10 comprises a product chain 12 in the form of an endless belt comprising spaced horizontal compartments. FIG. 1 shows only a portion of the upper product chain segment. Product chain 12 is bent and returns in customary fashion at its ends on both sides (means not shown). Arrow 14 indicates the direction of movement of product chain 12 along which product compartments 16 are provided. The product containers are arranged transversely to the direction of movement 14 of the product chain between a pair of spacer walls 18 and 20 defining compartments in which the products are held. Spacer walls 18 and 20 of product container 16 are on one side of product chain 12 which will be designated as an ejection side, and extend beyond the edge of the belt.

One form of product 22 is shown being introduced into product compartmemts 16 in FIG. 1. As may be seen from the Figure, the product is a vial such as may contain medication, etc. Other "products" being packaged may be bottles, blisterpacks, soaps, and similar items.

Figure 3:
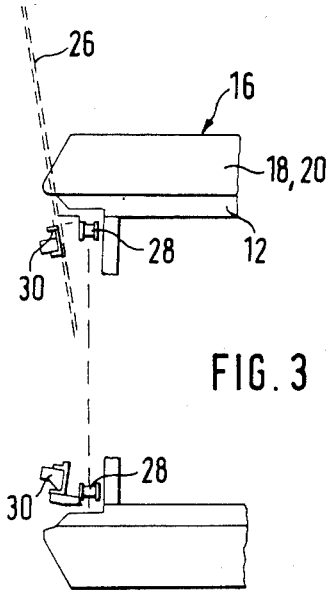
FIG. 3 is a view of the position at which the inserts are transferred from the pincers of the insert pincer chains at the insertion location of the products being packaged in containers in cross section along line III—III of FIG. 1.

Beginning at a predetermined location, and certainly at an insertion zone 24, product 22 is ejected off of product belt 12 together with inserts 26, for example, in the customary manner, into a container. An insert pincer chain 28 moves past insertion zone 24. Chain 28 brings insert-holding pincers 30 under product chain 12 but in parallel movement therewith. Inserts 26 are held essentially vertically by insert pincers 30 as may be seen from FIG. 3 such that ends of spacers 18 and 20 extending beyond the edge of product chain 12 in front of a product compartment 16 overhang such that if desired the inserts may be stabilized and aligned by means of the edges of walls 18 and 20 at their locations.

A transfer zone 32 at which inserts 26 are transferred in folded form from conveyors or transport belts 34 and 36 leading from a folding apparatus (not shown) is positioned near and somewhat below product chain 12 ahead of insertion zone 24 with respect to the direction of movement of product chain 12. Transport belts 34 and 36 initially lie flat on one another and hold an insert between them which was supplied by the insert folding apparatus. Transport belts 34 and 36 are then first reversed around roller 38 to move along an essentially vertically extending travel path. In the section of the essentially vertical path of movement of transport belts 34 and 36, at transfer zone 32, the transport belts move away from one another at a small angle and then along two reversal rollers 40 and 42 which are spaced vertically above transport belts 34 and 36 and roller 38 and are spaced horizontally relative to one another.

Transport belts 34 and 36 are wound around rollers 40 and 42 such that the conveyor belt 34 is reversed essentially by 180° at reversal roller 40 and transport belt 36 is passed at an angle of 90° around roller 42. Inserts 26 are freed from between transport belts 34 and 36 at transfer zone 32 such that they can be taken up by insert pincer chain 28. A movable stop 44 is positioned above roller 38 by means of which the inserts are aligned accurately and exactly by alignment means along a path parallel to their transport direction.

Insert pincer chain 28 is arranged at its reversal zone 46 at a definite distance from product chain 12 at transfer zone 32 which is adjacent to reversal zone 46. To achieve this, insert pincer chain 28 is brought to a section 48 in the form of a bend of the contiguous direction of extension and of movement in the insertion zone 24 and then moves straight back to reversal zone 46, this time moving at an angle to product chain 12.

The insert pincer chain is led vertically directly (linearly) by means of two vertically-stacked reversal rollers 50 and 52 to transfer zone 32 of transport or conveyor belts 34 and 36. To one side of reversal zone 46 which is under rotating roller 52, a wider roller 54 is provided which is essentially parallel to roller 52 and arranged along an extended axis over which insert pincer chain 28 is directed in the opposite direction to the movement of reversal roller 52, i.e., it is moved along an S-shaped path between rollers 52 and 54 whereby the distance of the upper extreme and lower extreme of the insert pincer chain from the height of the reversal zone 46 is reduced and insert pincer chain 28 assumes only a low height along its entire extension.

Figure 2:
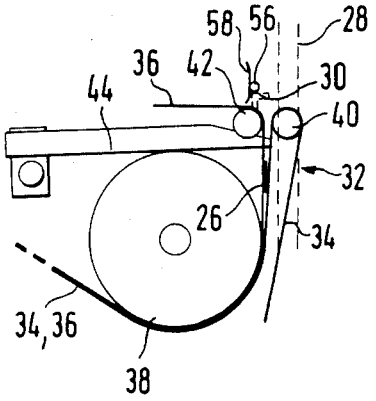
FIG. 2 is a side view of the conveyor belts at the transfer zone in cross section along line II—II of FIGS. 1 and 4.
Figure 4:
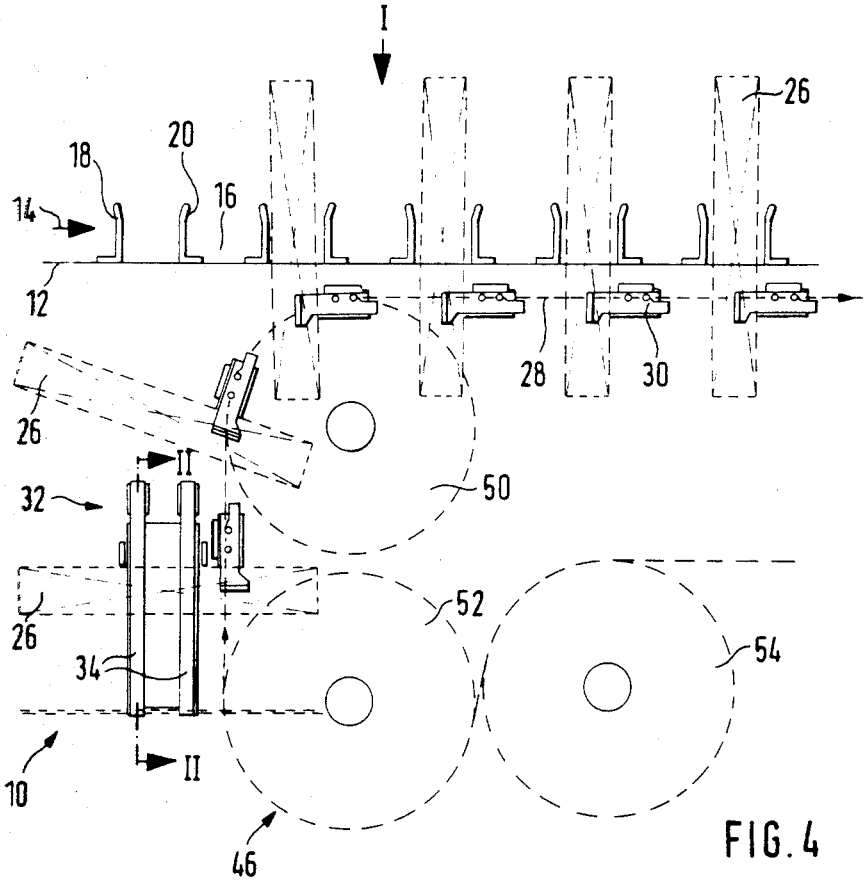
FIG. 4 is a side view of the inventive apparatus along arrow IV of FIG. 1.

Transport belts 34 and 36 and the insert pincer chain are brought together on top of one another at transfer zone 32 whereby insert pincers 30 are positioned to move exactly along the path of the outwardly extending inserts 26, which inserts are moved by means of transport belts 34 and 36, at least along the side facing insert pincers 30, to extend beyond the width of transport belts 34 and 36. Insert pincers 30 are opened by means of a technique which is of itself known, e.g., by means of a spring biased pincer arm 56 (see FIGS. 1 and 2), which is moved along a stationary contoured or cammed surface 58 such that the pincers are held open in transfer zone 32 against a closing spring force. The supply velocity of the transport belts 34 and 36 is greater than the velocity of insert pincer chain 28 such that inserts 26 are brought by means of transport belts 34 and 36 from the bottom up into opened insert pincers 30 (see FIG. 4). The inserts are then released by means of the separation of transport belts 34 and 36. As a result of the release of pincer arms 30 off of surface 58, the arms pince and take up the inserts which are subsequently advanced in a known manner shown in FIG. 4 such that they are first moved essentially vertically and positioned in front of the individual product compartments. Then, as a result of the inclined path near and in front of the opening as well as in front of the product, product 22 and insert 26 are both inserted in a known manner within an outer container or package at which point the pincers are opened, likewise in a conventional manner, and not shown.

Although the invention has been described with reference to particular means, materials, and embodiments it is to be understood that the invention is not limited to the particulars disclosed but extends to all equivalents falling within the scope of the claims.

What is claimed is:

1. Apparatus for positioning inserts relative to products on a product chain prior to packaging said products within respective product containers, said apparatus comprising insert transport belts for conveying said inserts to an insert pincer chain, in a transfer zone in which said inserts are transferred from said transport belts to said pincer chain, said insert pincer chain comprising means for positioning said inserts relative to said products prior to release from said pincer chain, said pincer chain being positioned below said product chain and being directed alongside said product chain in an insertion zone in which said inserts are inserted into product containers, said insert pincer chain being inclined relative to said product chain and being generally positioned such that said insert pincer chain moves beneath said product chain along said insertion zone, wherein said products are inserted into respective product containers.

2. The apparatus as defined by claim 1 wherein said inserts are positioned by said insert pincer chain perpendicularly relative to said products on said product chain.

3. The apparatus as defined by claim 1 wherein the direction of said insert pincer chain leaving said transfer zone is parallel to the direction of said product chain going towards said insertion zone, and wherein the direction of said insert pincer chain is reversed at said insertion zone.

4. The apparatus as defined by claim 1 wherein said insert transport belts comprise two belts adapted to convey each of said inserts individually between them to said transfer zone and to release each of said inserts in said transfer zone, and wherein the edges of said insert transport belts are positioned tangentially to said insert pincer chain.

5. The apparatus as defined by claim 1 wherein said insert pincer chain comprises individual pincers adapted to take up each of said inserts from said insert transport belts.

6. The apparatus as defined by claim 5 further comprising alignment means positioned to align each of said inserts for take-up by each of said pincers.

7. The apparatus as defined by claim 6 wherein said alignment means is movable along a direction parallel to the direction of movement of each of said inserts by said insert pincer chain.

8. The apparatus as defined by claim 7 wherein said insert pincer chain comprises reversal means for directing said insert pincer chain vertically linearly in a reversal zone adjacent to said transfer zone.

9. The apparatus as defined by claim 8 wherein said reversal means comprises two rotating reversal rollers positioned on top of one another.

10. The apparatus as defined by claim 9 further comprising an additional roller adjacent to the lower of said two reversal rollers, such that said insert pincer chain moves along each of said reversal and additional rollers, and wherein said insert pincer chain moves along an S-shaped path between said additional roller and said lower of said reversal rollers.

11. The apparatus as defined by claim 9 wherein said additional roller is wider than said lower reversal roller.

* * * * *